US007107903B2

(12) United States Patent
Tokinaga et al.

(10) Patent No.: US 7,107,903 B2
(45) Date of Patent: Sep. 19, 2006

(54) SHEET-FED PRINTING PRESS

(75) Inventors: Minoru Tokinaga, Fuchu (JP); Masamichi Sasaki, Fuchu (JP); Kiyomi Utsumi, Fuchu (JP)

(73) Assignee: Ryobi Ltd., Hiroshima-Ken (JP)

( * ) Notice: Subject to any disclaimer, the term of this patent is extended or adjusted under 35 U.S.C. 154(b) by 0 days.

(21) Appl. No.: 11/112,914

(22) Filed: Apr. 22, 2005

(65) Prior Publication Data

US 2005/0235847 A1 Oct. 27, 2005

(30) Foreign Application Priority Data

Apr. 23, 2004 (JP) ..... 2004-127587

(51) Int. Cl.
*B41F 13/24* (2006.01)

(52) U.S. Cl. ..... 101/232; 400/708; 271/258.01; 271/265.01

(58) Field of Classification Search ..... 101/232; 400/578, 582, 703, 708, 711; 226/45; 271/262–264, 271/258.02–258.04, 265.01–265.04
See application file for complete search history.

(56) References Cited

U.S. PATENT DOCUMENTS 6,053,495 A * 4/2000 Hara et al. ..... 271/263
7,025,348 B1 * 4/2006 Phinney et al. ..... 271/262
2001/0042956 A1 * 11/2001 Minoru et al. ..... 271/265.04

FOREIGN PATENT DOCUMENTS

JP 6-263288 9/1994

OTHER PUBLICATIONS

Patent Abstracts of Japan, Publication No. 06-263288, Publication Date Sep. 20, 1994, 1 page.

* cited by examiner

*Primary Examiner*—Minh Chau
(74) *Attorney, Agent, or Firm*—Osha Liang LLP

(57) ABSTRACT

There is provided a sheet-fed printing press that is capable of rapidly performing printing preparatory work for more secured double sheet detection. A double-sheet-detector control part judges whether an ultrasonic double sheet detector outputs double sheet detected signal during test printing or during feeding a first printing sheet of successively fed printing sheets in large quantity or successive printing. Where double sheet detected signal was output, it is judged that the detection made by the ultrasonic double sheet detector is erroneous so that the double-sheet-detector control part switches to a photoelectric double sheet detector to be employed as a double sheet detector for use in large quantity or successive printing. On the other hand, where no double sheet detected signal was output, it is judged that the detection made by the ultrasonic double sheet detector is correct so that the double-sheet-detector control part keeps the ultrasonic double sheet detector in operation to employ the same as a double sheet detector for use in large quantity or successive printing.

3 Claims, 4 Drawing Sheets

SHEET-FED PRINTING PRESS

CROSS REFERENCE TO RELATED APPLICATION

This application claims priority from Japanese Patent Application No. 2004-127587, which is incorporated herein by reference.

BACKGROUND OF THE INVENTION

1. Field of the Invention

The present invention relates to a sheet-fed printing press that is equipped with a double sheet detector for detecting whether two or more overlapped printing sheets are being fed, and more particularly a sheet-fed printing press that is equipped with both a photoelectric double sheet detector and an ultrasonic double sheet detector.

2.Related Art

In a sheet-fed printing press, a feeding section feeds printing sheets one by one to a printing section where printing sheets are printed one by one. For the purpose of securing printing operation by checking that printing sheets are being fed one by one, a conventional printing press is equipped with a double sheet detector that outputs a signal representative of detection of feeding of two or more overlapped printing sheets to the printing section (hereinafter simply referred to double sheet detected signal) when the detector has determined that two or more overlapped printing sheets are being fed to the printing section.

Conventional double sheet detectors include a photoelectric double sheet detector and an ultrasonic double sheet detector, the former being designed to irradiate light to printing sheets and detect such a double sheet feeding state based upon the detected difference in transmitted light therefrom, the latter being designed to emit ultrasonic sound to printing sheets and detect such a double sheet feeding state based on the detected information on whether an air layer exists. These detector are properly selected for use in printing depending on the intended use. As used throughout the description, the term "double sheet" is meant as two or more overlapped sheets when it is used relative to printing sheets.

The reason why those detectors are selected is that they each have advantage and disadvantage depending on the intended use. That is, where transparent printing sheets or printing sheets having high shielding performance (or opaque sheet) are to be processed by a photoelectric double sheet detector, the difference in transmitted light is hardly caused and therefore the photoelectric double sheet detector is unlikely to accurately detect the double sheet feeding state. On the other hand, where printing sheets such as those in the form of an envelope having front rear sheet pieces overlapped to each other are to be processed by an ultrasonic double sheet detector, the ultrasonic double sheet detector erroneously determines that a double sheet feeding state exists, due to the presence of air layer between the two sheet pieces of a printing sheet, and therefore is unlikely to accurately detect the double sheet feeding state. Therefore, both types of the double sheet detector are to be selectively employed depending on the intended use. However, the manual selection by the operator between the two types of detector based on his or her determination involves a troublesome work. In addition, the operator is sometimes hard to select a proper type of detector for use in printing when the operator relies merely on his or her visual observation. Accordingly, there is a case where the double sheet feeding detection is made by an improper type of detector, which may result in erroneous detection.

In order to address the above problem, it is known such as in Japanese Patent Laid-open No. Hei-06-263288 that, where the above two types of detector are simultaneously used and at least one of them outputs double sheet detected signal, it is determined that a double sheet feeding state exists.

However, a double sheet detector as disclosed in the above prior reference still has a problem as stated below.

That is, as described above, where printing sheets in the form of such as an envelope having a hollow portion are to be processed by the ultrasonic double sheet detector disclosed such as in the above prior reference, the ultrasonic double sheet detector still cannot overcome a problem to erroneously output double sheet detected signal even when it detected a single printing sheet and hence perform erroneous detection.

In order to address the above problem, it is an object of the present invention to provide a sheet-fed printing press that is capable of selecting a proper double sheet detector and rapidly performing printing preparatory work for more secured double sheet detection.

SUMMARY OF THE INVENTION

According to one aspect of the present invention, there is provided a sheet-fed printing press that includes: a photoelectric double sheet detector and an ultrasonic double sheet detector, both being adapted to output double sheet detected signal when they each have judged that two or more overlapped sheets are being fed; and a double-sheet-detector control part for automatically switching the photoelectric double sheet detector and the ultrasonic double sheet detector so as to employ the photoelectric double sheet detector as a double sheet detector for use in large quantity or successive printing when the ultrasonic double sheet detector output double sheet detected signal during test printing or during feeding a first printing sheet of successively fed printing sheets in large quantity or successive printing, and employ the ultrasonic double sheet detector as a double sheet detector for use in large or successive printing when the ultrasonic double sheet detector did not output double sheet detected signal during test printing or during feeding a first printing sheet of successively fed printing sheets in large quantity or successive printing.

The above sheet-fed printing press includes the photoelectric double sheet detector and the ultrasonic double sheet detector, both detectors being adapted to output double sheet detected signal when they each have judged that two or more overlapped sheets are being fed, the former being designed to irradiate light to printing sheets and detect such a double sheet feeding state based upon the detected difference in transmitted light therefrom, the latter being designed to emit ultrasonic sound to printing sheets and detect such a double sheet feeding state based on the detected information on whether an air layer exists. This air layer is caused when two or more sheets have been overlapped. With this printing press, it is judged whether the ultrasonic double sheet detector output double sheet detected signal in test printing, for which only a single printing sheet is fed, or at the time of feeding a first printing sheet of successively fed printing sheets in large quantity or successive printing. In this detection, where double sheet detected signal was output, it is judged that the detection made by the ultrasonic double sheet detector is erroneous so that the double-sheet-detector control part switches to the photoelectric double sheet detector to be employed as a double sheet detector for use in large quantity or successive printing. On the other hand, where no double sheet detected signal was output, it is judged that the detection made by the ultrasonic double sheet detector is correct so that the double-sheet-detector control part keeps the ultrasonic double sheet detector in operation to employ the same as a double sheet detector for use in large quantity or successive printing.

The double sheet detection is made based on the result of the detection by the ultrasonic double sheet detector during test printing or during feeding a first printing sheet of successively fed printing sheets in large quantity or successive printing for the reason stated below.

The photoelectric double sheet detector does not detect such a double sheet feeding state because the photoelectric double sheet detector compares the transmitted light from a printing sheet of test printing or a first printing sheet of successively fed printing sheets in large quantity or successive printing to the transmitted light from a printing sheet in large quantity or successive printing (or the second or its subsequent printing sheet in large quantity of successive printing when compared with the first printing sheet of large quantity or successive printing), and therefore does not output double sheet detected signal during test printing or during feeding a first printing sheet of successively fed printing sheets in large quantity or successive printing. However, this photoelectric double sheet detector does not always detect a double sheet feeding state or does not always output double sheet detected signal when it detects an opaque sheet or a transparent sheet, since the difference is hardly caused even when the comparison is made between the transmitted light from a printing sheet of test printing or a first printing sheet of successively fed printing sheets in large quantity or successive printing and the transmitted light from two or more overlapped printing sheets in large quantity or successive printing. It is not therefore proper to employ the photoelectric double sheet detector as a double sheet detector for use in large quantity or successive printing. Specifically, there is a case where double sheet detected signal is not output even when two or more overlapped printing sheets, for each of which double sheet detected signal was not output during test printing or during feeding a first printing sheet of successively fed printing sheets in large quantity or successive printing, are being fed or brought into a double sheet feeding state in large quantity or successive printing. Therefore, it is difficult to properly select a double sheet detector to be used for large quantity or successive printing based on the result of the detection made by the photoelectric double sheet detector in test printing (or at the time of feeding a first printing sheet of successively fed printing sheets in large quantity or successive printing).

On the contrary, as long as printing sheets fed for large quantity or successive printing are those for which no double sheet detected signal output during test printing or are those having uniform quality, double sheet detected signal can be output without fail when two or more overlapped printing sheets of them are actually being fed in large quantity or successive printing or a double sheet feeding state has been caused. Accordingly, it is possible to easily select a double sheet detector to be employed in large quantity or successive printing based on the result of the detection made by the ultrasonic double sheet detector in test printing (or at the time of feeding a first printing sheet of successively fed printing sheets in large quantity or successive printing).

Thus, it is judged which of the double sheet detectors are to be employed in large quantity or successive printing based on the result of the detection made by the ultrasonic double sheet detector in test printing (or at the time of feeding a first printing sheet of successively fed printing sheets in large quantity or successive printing) so that a proper double sheet detector can be selected, and whereby it is possible to more rapidly performs printing preparatory work for more secured double sheet detection.

According to another aspect of the present invention, there is provided a sheet-fed printing press that includes: a photoelectric double sheet detector and an ultrasonic double sheet detector, both being adapted to output double sheet detected signal when they each have judged that two or more overlapped sheets are being fed; and a double-sheet-detector control part for automatically switching the photoelectric double sheet detector and the ultrasonic double sheet detector so as to employ the photoelectric double sheet detector as a double sheet detector for use in large quantity or successive printing when the ultrasonic double sheet detector output double sheet detected signal during test printing or during feeding a first printing sheet of successively fed printing sheets in large quantity or successive printing, employ the ultrasonic double sheet detector as a double sheet detector for use in large or successive printing when the ultrasonic double sheet detector did not output double sheet detected signal while the photoelectric double sheet detector output double sheet detected signal during test printing or during feeding a first printing sheet of successively fed printing sheets in large quantity or successive printing, and employ at least one of the photoelectric double sheet detector and the ultrasonic double sheet detector as a double sheet detector for use in large or successive printing when both the photoelectric double sheet detector and the ultrasonic double sheet detector did not output double sheet detected signal during test printing or during feeding a first printing sheet of successively fed printing sheets in large quantity or successive printing.

The above sheet-fed printing press includes the photoelectric double sheet detector and the ultrasonic double sheet detector, both detectors being adapted to output double sheet detected signal when they each have judged that two or more overlapped sheets are being fed, the former being designed to irradiate light to printing sheets and detect such a double sheet feeding state based upon the detected difference in transmitted light therefrom, the latter being designed to emit ultrasonic sound to printing sheets and detect such a double sheet feeding state based on the detected information on whether an air layer exists. This air layer is caused when two or more sheets have been overlapped. With this printing press, it is judged whether the photoelectric double sheet detector and the ultrasonic double sheet detector each output double sheet detected signal during test printing, for which only a single printing sheet is fed, or during feeding a first printing sheet of successively fed printing sheets in large quantity or successive printing. In this detection, where double sheet detected signal was output by the ultrasonic double sheet detector, it is judged that the detection made by the ultrasonic double sheet detector is erroneous so that the double-sheet-detector control part switches to the photoelectric double sheet detector to be employed as a double sheet detector for use in large quantity or successive printing. On the other hand, where no double sheet detected signal was output by the ultrasonic double sheet detector while double sheet detected signal was output by the photoelectric double sheet detector, it is judged that the detection made by the photoelectric double sheet detector is erroneous so that the double-sheet-detector control part controls both the detectors to employ the ultrasonic double sheet detector as a double sheet detector for use in large quantity or successive printing. Further, where no double sheet detected signal was output by each of the photoelectric double sheet detector and the ultrasonic double sheet detector, it is judged that the detection made by each of the detectors is correct so that the double-sheet-detector control part controls both the detectors to employ at least one of the photoelectric double sheet detector and the ultrasonic double sheet detector as a double sheet detector for use in large quantity or successive printing.

Thus, by the judgment of which double sheet detector is to be employed based on the combination of the results of the detections made by the photoelectric double sheet detector and the ultrasonic double sheet detector during test printing or during feeding a first printing sheet of successively fed printing sheets in large quantity or successive printing, it is possible to select a proper double sheet detector and thus achieve rapid printing preparatory work for more secured double sheet detection. In addition, it is possible to perform more secured double sheet detection in large quantity or successive printing by employing both the photoelectric double sheet detector and the ultrasonic double sheet detector wherever possible.

According to still another aspect of the present invention, there is provided a sheet-fed printing press that includes: a photoelectric double sheet detector and an ultrasonic double sheet detector, both being adapted to output double sheet detected signal when they each have judged that two or more overlapped sheets are being fed; and a notifier for notifying an operator which double sheet detector of the double sheet detectors is to be employed, so that the notifier notifies the operator that the photoelectric double sheet detector is to be employed as a double sheet detector for use in large quantity or successive printing when the ultrasonic double sheet detector output double sheet detected signal during test printing or during a first printing sheet of successively fed printing sheets in large quantity or successive printing, and the notifier notifies the operator that the ultrasonic double sheet detector is to be employed as a double sheet detector for use in large or successive printing when the ultrasonic double sheet detector did not output double sheet detected signal.

The above sheet-fed printing press includes the photoelectric double sheet detector and the ultrasonic double sheet detector, both detectors being adapted to output double sheet detected signal when they each have judged that two or more overlapped sheets are being fed, the former being designed to irradiate light to printing sheets and detect such a double sheet feeding state based upon the detected difference in transmitted light therefrom, the latter being designed to emit ultrasonic sound to printing sheets and detect such a double sheet feeding state based on the detected information on whether an air layer exists. This air layer is caused when two or more sheets have been overlapped. The notifier notifies the operator so as to allow him or her to recognize the fact as to whether the ultrasonic double sheet detector output double sheet detected signal in test printing, for which only a single printing sheet is fed, or at the time of feeding a first printing sheet of successively fed printing sheets in large quantity or successive printing. In this detection, where double sheet detected signal was output, it is judged that the detection made by the ultrasonic double sheet detector is erroneous so that the notifier notifies the operator that the photoelectric double sheet detector is to be employed as a double sheet detector for use in large quantity or successive printing. On the other hand, where no double sheet detected signal was output, it is judged that the detection made by the ultrasonic double sheet detector is correct so that the notifier notifies the operator that the ultrasonic double sheet detector is to be kept in operation so as to be employed as a double sheet detector for use in large quantity or successive printing.

Thus, by the notification of which double sheet detector is to be employed, based on the result of the ultrasonic double sheet detector during test printing or during feeding a first printing sheet of successively fed printing sheets in large quantity or successive printing, the operator can select a proper double sheet detector and thus rapidly perform printing preparatory work for more secured double sheet detection.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
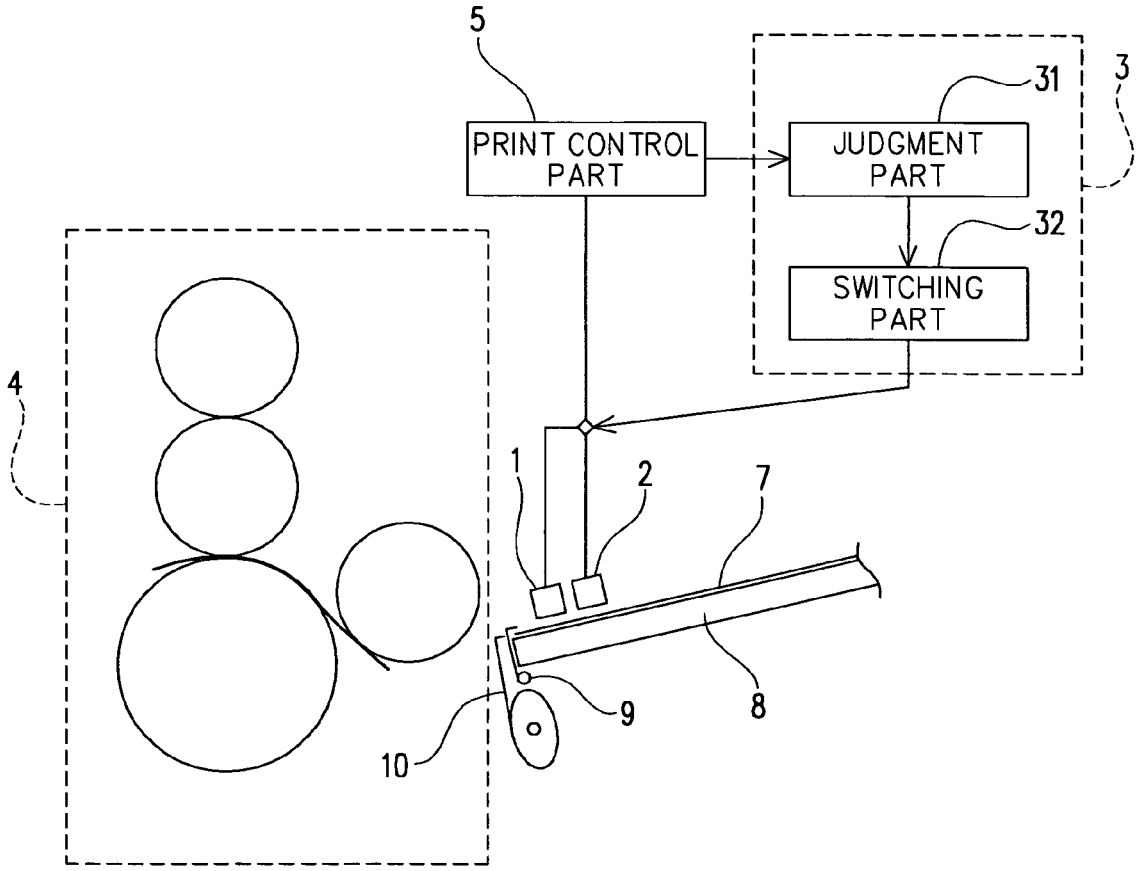
FIG. 1 is a schematic partial view of a sheet-fed printing press according to a first embodiment of the present invention.

Now, the description will be made for the embodiments of the present invention with reference to the drawings attached hereto. FIG. 1 a schematic partial view of a sheet-fed printing press according to a first embodiment of the present invention.

The sheet-fed printing press of this embodiment is equipped with a photoelectric double sheet detector 1 and an ultrasonic double sheet detector 2, each being designed to output double sheet detected signal when it has determined that two or more overlapped printing sheets are being fed. The sheet-fed printing press is also equipped with a double-sheet-detector control part 3 for automatically switching to a proper double sheet detector to be employed in large quantity or successive printing, so that where the ultrasonic double sheet detector 2 output double sheet detected signal based on its detected result during test printing or during feeding a first printing sheet of successively fed printing sheets in large quantity or successive printing, the photoelectric double sheet detector 1 is employed as a double sheet detector for use in large quantity or successive printing; and where the ultrasonic double sheet detector 2 did not output double sheet detected signal, the ultrasonic double sheet detector 2 is employed as a double sheet detector for use in large quantity or successive printing.

In this embodiment, a print control part 5 is equipped in the printing press to receive double sheet detected signal output from the photoelectric double sheet detector 1 or the ultrasonic double sheet detector 2, and transmit double sheet detected signal output from the ultrasonic double sheet detector 2 to the double-sheet-detector control part 3 during test printing or during feeding a first printing sheet of successively fed printing sheets in large quantity or successive printing, and to control the entire operation of the sheet-fed printing press such as to stop the printing operation based on double sheet detected signal in large quantity or successive printing.

The double-sheet-detector control part 3 of this embodiment includes a judgment part 31 for judging the detected result of the ultrasonic double sheet detector 2 or judging whether double sheet detected signal output was received via the print control part 5, and a switching part 32 for automatically switching to the photoelectric double sheet detector 1 or the ultrasonic double sheet detector 2 based on the judged result of the judgment part 31. The switching part 32 of the double-sheet-detector control part 3 is designed so as to be able to mechanically or digitally switch to either the photoelectric double sheet detector 1 or the ultrasonic double sheet detector 2 to employ the same as a double sheet detector for use in large quantity or successive printing, based on the judged result of the judgment part 31. The print control part 5 and the double-sheet-detector control part 3, or more specifically the judgment part 31 and the switching part 32 can be realized by a CPU of a computer connected to or installed in the sheet-fed printing press.

In this embodiment, as illustrated in FIG. 1, there is further provided a print section 4 for printing, a feeder board 8 for transferring printing sheets 7 one by one to the print section 4, a front-edge abutting member 9 for positioning each printing sheet by abutting with the front edge of each printing sheet transferred so as to position the same at an end of the feeder board 8, and a swing arm 10 equipped with a gripper for gripping the front edge of each printing sheet held in position and feeding the same to the print section 4. The photoelectric double sheet detector 1 and the ultrasonic double sheet detector 2 are disposed in proximity to the end of the feeder board 8 so as to enable detection of two or more overlapped printing sheets 7 (two overlapped printing sheets in this embodiment) during they are held in a stopped state by the front-edge abutting member 9.

It is to be noted that other structural parts of the sheet-fed printing press, such as a sheet feeding section or a sheet discharging section, which are not shown in FIG. 1, are not limited to specific ones while various members or parts are applicable thereto, and therefore are intentionally not illustrated in the drawings.

According to the sheet-fed printing press having the above arrangement, there is provided the photoelectric double sheet detector 1 that irradiates light to each printing sheet 7 and detects whether two or more overlapped printing sheets 7 are being fed, based on the difference in transmitted light, and the ultrasonic double sheet detector 2 that emits ultrasonic sound to each printing sheet 7 and detects whether two or more overlapped printing sheets 7 are being fed, based on the presence or absence of an air layer, which is caused when sheet pieces are overlapped to each other. Both detectors are mounted in position so as to output double sheet detected signal when they each determined that two or more overlapped printing sheets are being fed, as described above. Any one of the photoelectric double sheet detector 1 and the ultrasonic double sheet detector 2 may be designed to transmit double sheet detected signal to the print control part 5 when it judged that two or more overlapped printing sheets are being fed, or to transmit a signal representative of detection of feeding of a single printing sheet (hereinafter simply referred to single sheet detected signal) to the print control part 5 when it judged that printing sheets are being fed one by one in a proper feeding operation.

Figure 2:
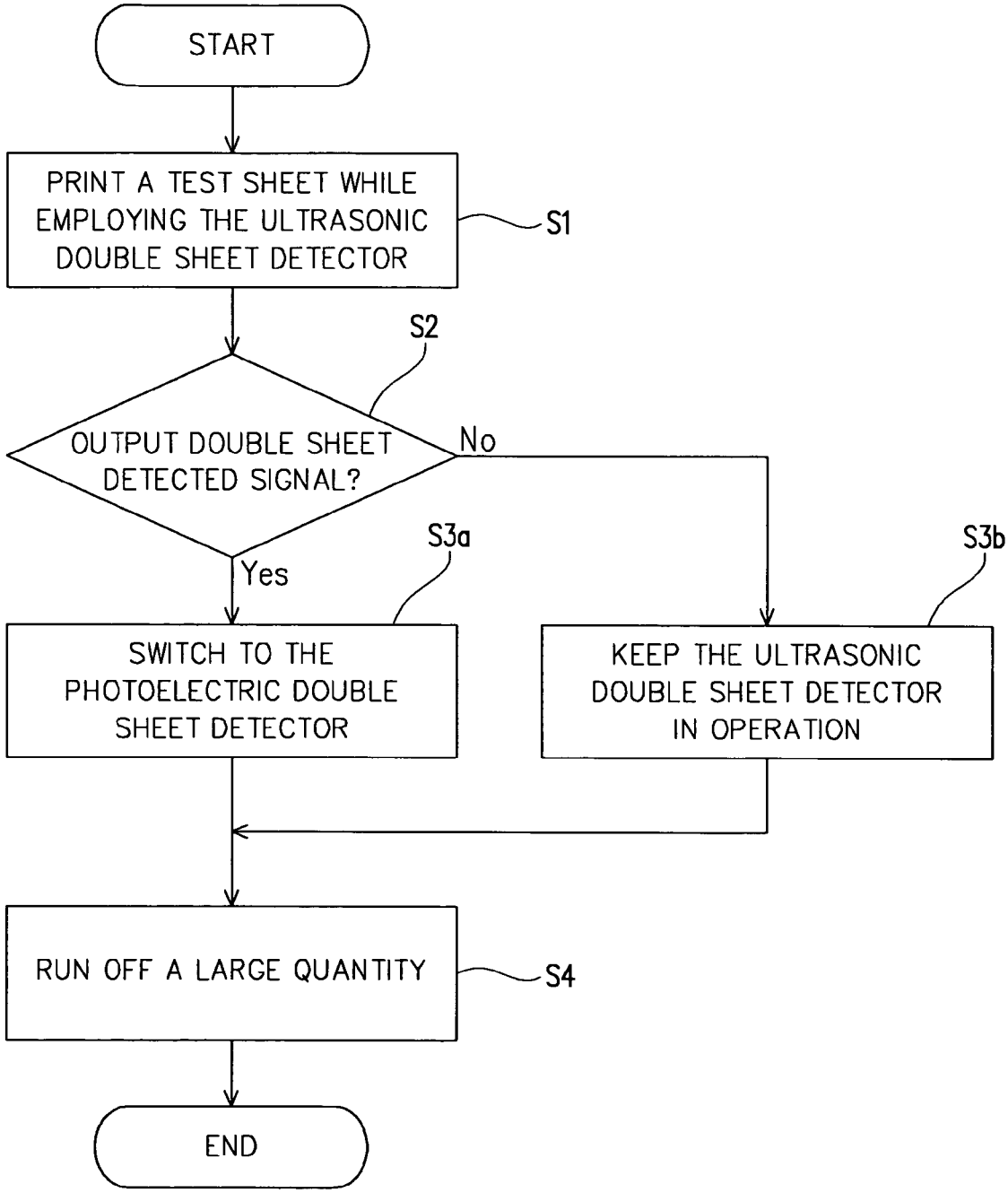
FIG. 2 is a flowchart illustrating a control process of double sheet detectors of the first embodiment.

FIG. 2 is a flowchart illustrating a control process of the double sheet detectors of this embodiment. Although the description will be made by taking for example the case where the double sheet detectors are to be controlled during test printing before large quantity or successive printing, in which only a single sheet is fed during this test printing, the same description will be applicable to the case where the double sheet detectors are to be controlled during feeding a first printing sheet of successively fed printing sheets in large quantity or successive printing. It is possible to employ either control manner described above or an arrangement allowing automatic switching of the control manner or allowing the operator to switch to either control manner at his or her discretion.

First, the printing press is started to print a test sheet before running off large quantity or successive printing (Step S1). At this moment, the double-sheet-detector control part 3 controls the switching part 32 to switch to the ultrasonic double sheet detector 2 as a double sheet detector to be employed and actuate the same, while feeding a printing sheet 7 to the front-edge abutting member 9 via the feeder board 8. The feeding of this printing sheet 7 in test printing may be manually made by the operator. The ultrasonic double sheet detector 2 performs double sheet detection to the printing sheet 7 fed to the position, and transfers the result of the double sheet detection (i.e., whether or not double sheet detected signal is to be output) to the judgment part 31 of the double-sheet-detector control part 3 via the print control part 5. Upon receiving this result, the judgment part 31 of the double-sheet-detector control part 3 judges whether the ultrasonic double sheet detector 2 output double sheet detected signal (Step S2).

Where the ultrasonic double sheet detector 2 output double sheet detected signal during test printing ("YES" in Step S2), the judgment part 31 judges that the double sheet detection made by the ultrasonic double sheet detector 2 is erroneous; and transmits signal to the switching part 32 so as to switch to the photoelectric double sheet detector 1 to employ the same as a double sheet detector for use in large quantity or successive printing so that the switching of the double sheet detectors is made by the switching part 32 upon receiving the signal (Step S3*a*). On the other hand, where the ultrasonic double sheet detector 2 did not output double sheet detected signal ("NO" in Step S2), the judgment part 31 judges that the double sheet detection made by the ultrasonic double sheet detector 2 is correct; and transmits signal to the switching part 32 so as to keep the ultrasonic double sheet detector 2 in operation so that the ultrasonic double sheet detector 2 is employed as a double sheet detector for use in large quantity or successive printing (Step S3*b*). Thus, the printing press runs off a large quantity while performing double sheet detection by employing a proper double sheet detector selected in Steps S3*a* and S3*b* (Step S4).

The double sheet detection is made based on the result of the detection by the ultrasonic double sheet detector 2 in test printing for the reason stated below.

"ON" and "OFF" in Table 1 shown below respectively represent presence and absence of output double-sheet-detected-signal from each of the photoelectric double sheet detector 1 and ultrasonic double sheet detector 2.

TABLE 1

| | PHOTOELECTRIC DOUBLE SHEET DETECTOR | ULTRASONIC DOUBLE SHEET DETECTOR |
|---|---|---|
| REGULAR SHEET WITH LIGHT TRANSPARENCY | OFF | OFF |
| OPAQUE SHEET | OFF (ON) | OFF |
| TRANSPARENT SHEET | OFF | OFF |
| ENVELOPE | OFF | ON (ERRONEOUS DETECTION) |

The photoelectric double sheet detector 1 does not output double sheet detected signal for all the above printing sheets and always detects each of them as a single printing sheet in test printing, because the photoelectric double sheet detector 1 compares the transmitted light from a printing sheet 7 in test printing to the transmitted light from a printing sheet 7 in large quantity or successive printing. Therefore, the photoelectric double sheet detector 1 does not generally output double sheet detected signal in test printing (an exceptional case will be described later). This photoelectric double sheet detector 1, even when the comparison is made, does not always detect a double sheet feeding state or does not always output double sheet detected signal when it detects an opaque sheet 7 (including such as a thick sheet, an aluminum sheet or a resin sheet), or a transparent sheet, since the difference is hardly caused even when the comparison is made between the transmitted light from a printing sheet 7 in test printing and the transmitted light from two or more overlapped printing sheets in large quantity or successive printing.

It is not therefore proper in the above case to employ the photoelectric double sheet detector 1 as a double sheet detector for large quantity or successive printing. Specifically, there is a case where a double sheet feeding state is not detected even when two or more overlapped printing sheets 7, for each of which double sheet detected signal was not output in test printing, are being fed in large quantity or successive printing. Therefore, it is difficult to select a double sheet detector suitable for large quantity or successive printing based on the result of the detection by the photoelectric double sheet detector 1 in test printing.

On the contrary, the ultrasonic double sheet detector 2 erroneously judges feeding of a double layered sheet such as an envelope as a double sheet feeding state and then outputs double sheet detected signal. However, as long as printing sheets 7 fed for large quantity or successive printing are those for which no double sheet detected signal was output in test printing or are those having uniform quality, double sheet detected signal can be output without fail when two or more overlapped printing sheets of them are actually being fed in large quantity or successive printing. Accordingly, it is possible to easily select a double sheet detector suitable for large quantity or successive printing based on the result of the detection of the ultrasonic double sheet detector 2 in test printing.

Thus, the judgment is made for a double sheet detector to be employed in large quantity or successive printing based on the result of the ultrasonic double sheet detector 2 in test printing so that a proper double sheet detector can be selected, and whereby it is possible to rapidly performs printing operation for more secured double sheet detection.

The switching part 32 of this embodiment is required only to perform switching operation on whether the judged result of the judgment part 31 is employed or not, and therefore is not necessarily required to perform switching operation to actuate only one of the double sheet detectors 1, 2. That is, it is possible to employ an operation where, irrespective of which of the test printing or the large quantity or successive printing is being performed, both the double sheet detectors 1, 2 always perform double sheet detection and only the detected result (double sheet detected signal) of either double sheet detector employed by the switching part 32 is notified to the operator.

In this embodiment, it is possible to employ the arrangement where a notification section made up of a notification lamp of such as an LED or a notification buzzer indicates which one of the photoelectric double sheet detector 1 and the ultrasonic double sheet detector 2 is currently in use. Whereby, the operator can easily check the double sheet detector 1, 2, which is currently employed by the double-sheet-detector control part 3, and hence double sheet detection can be more securely performed with high reliability.

The above description with reference to Table 1 was made based on the presumption where the photoelectric double sheet detector 1 does not generally output double sheet detected signal in test printing. In this respect, as mentioned above, an exception exists where, of various photoelectric double sheet detectors, some may judge a printing sheet as the one impossible to be judged when the printing sheet is an opaque sheet that transmits almost no light, and output double sheet detected signal based on this judgment. For effective use of this type of photoelectric double sheet detector, the photoelectric double sheet detector may be employed in test printing along with the ultrasonic double sheet detector 2.

That is, it is possible to employ a sheet-fed printing press that includes: a photoelectric double sheet detector 1 and an ultrasonic double sheet detector 2, both being adapted to output double sheet detected signal when they each have judged that two or more overlapped sheets are being fed; and a double-sheet-detector control part 3 for automatically switching the photoelectric double sheet detector 1 and the double sheet detector 2 so as to employ the photoelectric double sheet detector 1 as a double sheet detector for use in large quantity or successive printing when the ultrasonic double sheet detector 2 output double sheet detected signal during test printing or during feeding a first printing sheet of successively fed printing sheets in large quantity or successive printing, employ the ultrasonic double sheet detector 2 as a double sheet detector for use in large or successive printing when the ultrasonic double sheet detector 2 did not output double sheet detected signal while the photoelectric double sheet detector 1 output double sheet detected signal during test printing or during feeding a first printing sheet of successively fed printing sheets in large quantity or successive printing, and employ at least one of the photoelectric double sheet detector 1 and the ultrasonic double sheet detector 2 as a double sheet detector for use in large or successive printing when both the photoelectric double sheet detector 1 and the ultrasonic double sheet detector 2 did not output double sheet detected signal during test printing or during feeding a first printing sheet of successively fed printing sheets in large quantity or successive printing.

According to the above sheet-fed printing press, when both the ultrasonic double sheet detector 2 and the photoelectric double sheet detector 1 did not output double sheet detected signal (when printing sheets 7 are regular sheets), it is possible to employ both the photoelectric double sheet detector 1 and the ultrasonic double sheet detector 2. It is a matter of course that any one of the those detectors can be employed depending on the case.

Thus, by the judgment of which double sheet detector is to be used in large quantity or successive printing based on the combination of the results of the photoelectric double sheet detector 1 and the ultrasonic double sheet detector 2 in test printing or at feeding a first printing sheet of successive fed printing sheets in large quantity or successive printing, it is possible to select a proper double sheet detector and thus perform printing preparatory work for more secured double sheet detection. In addition, it is possible to perform more secured double sheet detection in large quantity or successive printing by employing both the photoelectric double sheet detector 1 and the ultrasonic double sheet detector 2 wherever possible.

In the above case, for transparent printing sheets, it may be judged that at least one of the photoelectric double sheet detector 1 and the ultrasonic double sheet detector 2 can be employed. However, as described above, this judgment may cause a problem since double sheet detection is not possible for transparent printing sheets if the photoelectric double sheet detector 1 has been employed. For preventing this problem, an arrangement allowing the operator to forcibly select the ultrasonic double sheet detector 2 may be employed, in which the printing press does not follow the judged result in test printing for transparent printing sheets. This manner of operation can be done because it is relatively easy for the operator to see the difference of transparent printing sheets from regular sheets. Particularly for such a case where transparent sheet printing is not planned at the start of the printing operation, an arrangement where the photoelectric double sheet detector 1 is used along with the ultrasonic double sheet detector 2 in test printing is employed. As a result, it is possible to employ both the double sheet detectors 1, 2 in large quantity or successive printing for regular printing sheets as most frequently used printing sheets, (printing sheets 7 that are neither highly opaque sheets nor envelopes), so that more secured double sheet detection can be accomplished.

Figure 3:
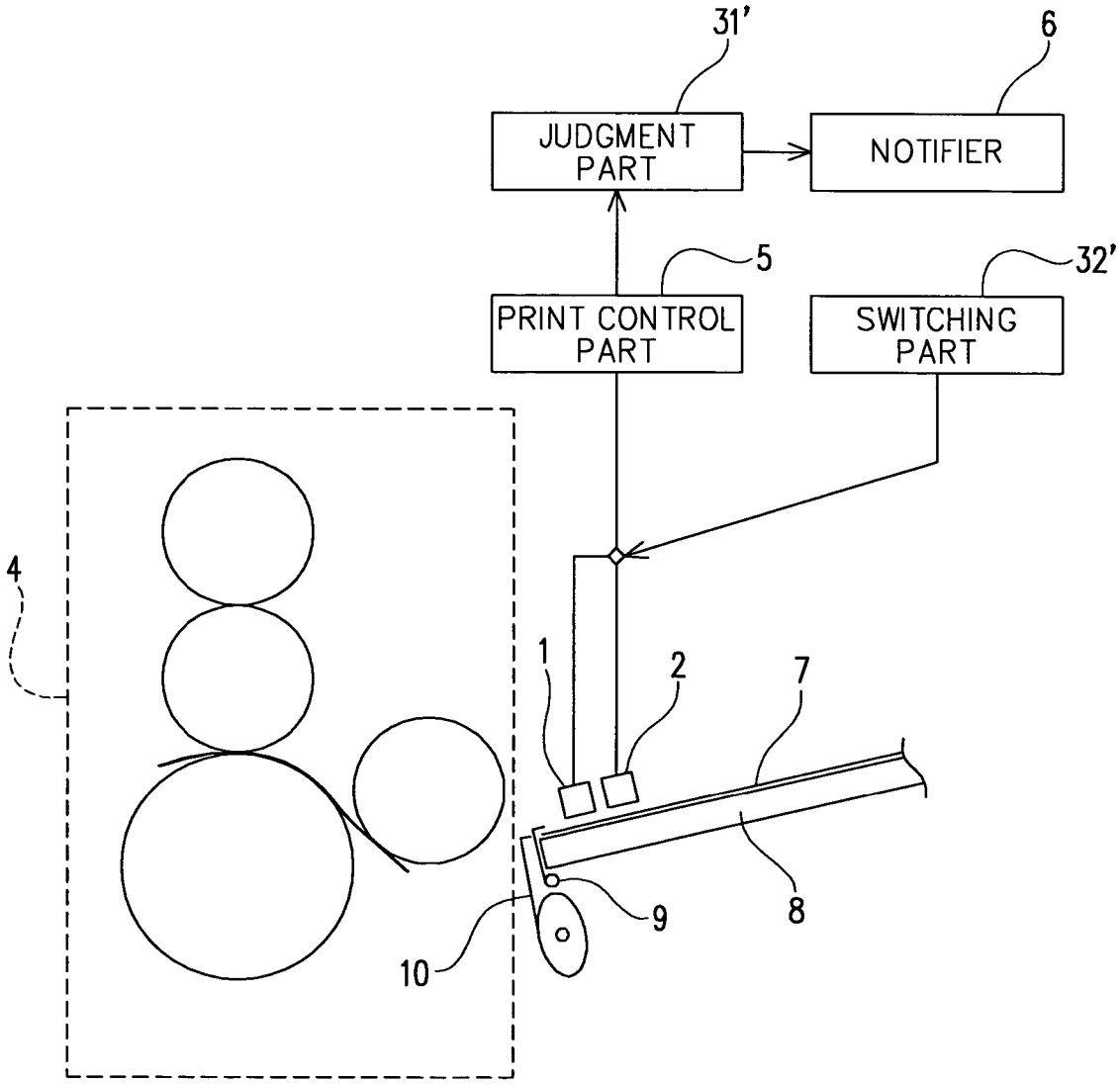
FIG. 3 is a schematic partial view of a sheet-fed printing press according to a second embodiment of the present invention.

Now, the description will be made for another embodiment of the present invention. FIG. 3 is a schematic partial view of a sheet-fed printing press according to a second embodiment of the present invention. The difference from the first embodiment lies in that a notifier 6 is provided in this embodiment to notify the operator so as to allow him or her to employ the photoelectric double sheet detector 1 as a double sheet detector for use in large quantity or successive printing when the ultrasonic double sheet detector 2 output double sheet detected signal during test printing prior to large quantity or successive printing or during feeding a first sheet of large quantity or successive printing; and employ the ultrasonic double sheet detector 2 as a double sheet detector for use in large quantity or successive printing when the ultrasonic double sheet detector 2 did not output double sheet detected signal.

In this embodiment, the sheet-fed printing press includes a print control part 5 that receives double sheet detected signal output from the photoelectric double sheet detector 1 or the ultrasonic double sheet detector 2, and receives double sheet detected signal output from the ultrasonic double sheet detector 2 during test printing or feeding a first printing sheet of successively fed printing sheets in large quantity or successive printing while controlling the entire operation of the printing press, such as stopping the printing operation, based on double sheet detected signal during large quantity or successive printing. The printing press further includes a judgment part 31' for judging the detected result of the ultrasonic double sheet detector 2 to judge whether double sheet detected signal has been received via the print control part 5, and a switching part 32' for switching to the double sheet detector which was notified to the operator by the notifier 6. In the following description, corresponding or identical parts or members to those of the printing press have been given the same reference characters to omit a detailed description thereof.

The notifier 6 used herein may be varied in form or structure as long as it can notify to the operator, allowing him or her to recognize which double sheet detector 1, 2 to employ. For example, a notification lamp or a notification buzzer may be employed. It is also possible to notify the double sheet detector by buzzer sounds, or by a display connected to a computer for control of the entire operation of the printing press, on which such as a lamp is displayed in GUI mode or the information is displayed in text mode. It is a matter of course to employ several notifier means in combination. The notification manner of the notifier 6 may also be varied. For example, it is possible to employ an arrangement to light any of two notification lamps, change the lighting mode of one of the notification lamps such as lighting a corresponding lamp only at the time when the double sheet detector is to be switched, or employ a different lighting mode suitable for each case. This possible variation in notification manner is also applicable to an arrangement where a notification buzzer or the like is employed.

Figure 4:
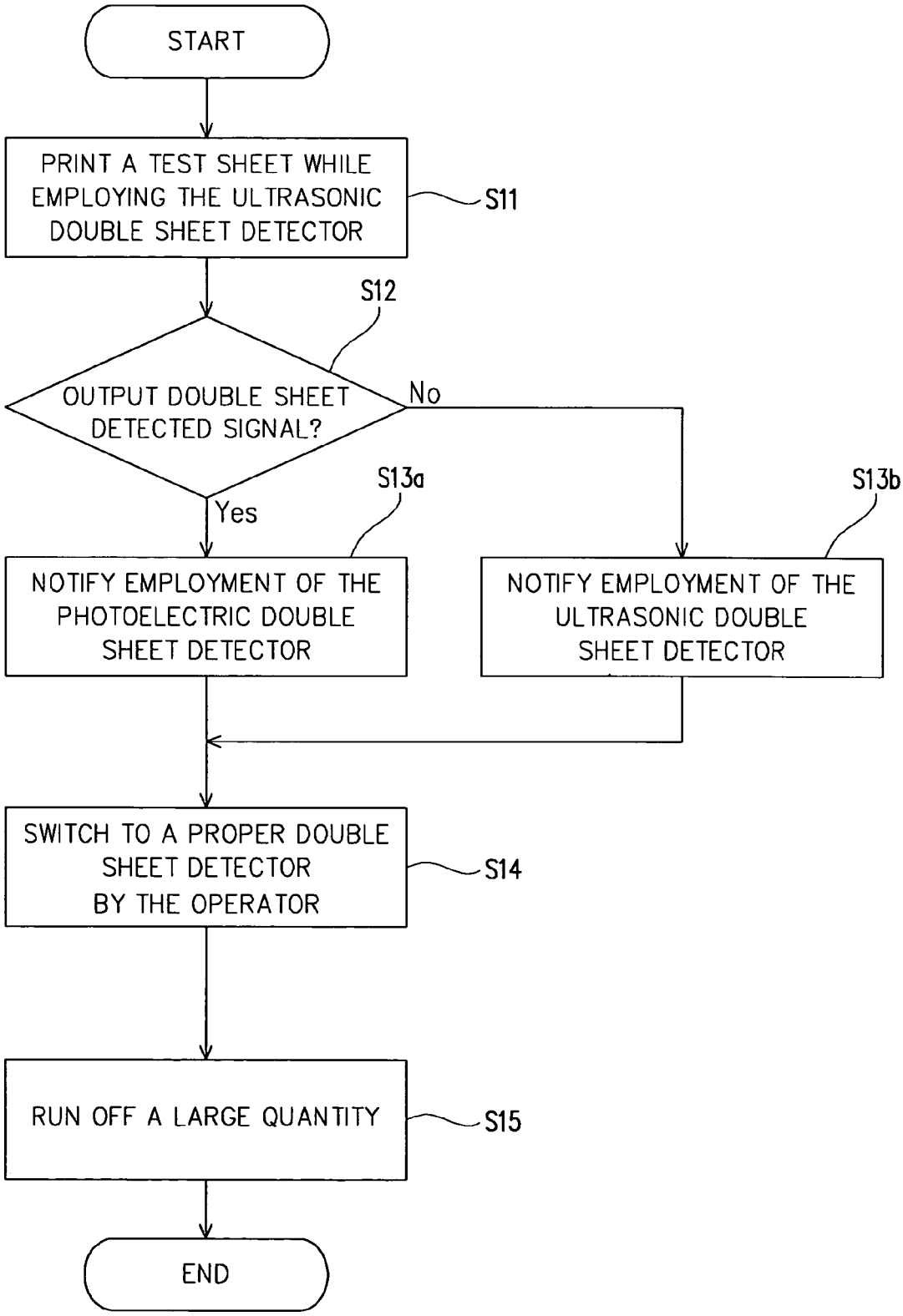
FIG. 4 is a flowchart illustrating a control process of double sheet detectors of the second embodiment.

FIG. 4 is a flowchart illustrating a control process of double sheet detectors of the second embodiment. The description will be made for the second embodiment in the same manner as the first embodiment by taking for example a case where the double sheet detectors are controlled during test printing, for which only a single sheet is fed, prior to large quantity or successive printing. This control process is also applicable to the case where the double sheet detectors are controlled during feeding a first sheet of successively fed printing sheets in large quantity or successive printing.

First, the sheet-fed printing press is started to print a test sheet before running off large quantity or successive printing (Step S11). The automatic control is made to employ the ultrasonic double sheet detector 2 as the double sheet detector to be used at this moment, while feeding a printing sheet 7 to the front-edge abutting member 9 via the feeder board 8. The ultrasonic double sheet detector 2 performs double sheet detection to the printing sheet 7 fed to the position, and transfers the result regarding the necessity or unnecessity to output double sheet detected signal via the print control part 5 to the judgment part 31', at which judgment is made on whether the ultrasonic double sheet detector 2 output double sheet detected signal (Step S12).

Where the ultrasonic double sheet detector 2 output double sheet detected signal during test printing ("YES" in Step S12), it is judged that erroneous detection is made by the ultrasonic double sheet detector 2, and hence the notifier 6 notifies the operator that the photoelectric double sheet detector 1 is to be employed in large quantity or successive printing (Step S13*a*). On the other hand, where no double sheet detected signal was output ("NO" in Step S12), it is judged that correct detection is made by the ultrasonic double sheet detector 2, and hence the notifier 6 notifies the operator that the ultrasonic double sheet detector 2 is to be continuously employed in large quantity or successive printing (Step S13*b*). The operator who was notified by the notifier 6 then manually operates the switching part 32' based on the notified result of the notifier 6, thereby switching to a proper double sheet detector or keep the currently employing detector in operation (Step S14).

The switching operation of the switching part 32' may be achieved by operating a switching lever or a switching button provided in the sheet-fed printing press, or inputting a command by means of an inputting means of a computer for control of the operation of the printing press (e.g., a mouse, a keyboard or a touch panel). On the assumption that there is a case that the switching operation made by the operator in Step S14 is inconsistent with the notified result of the notifier 6, the notifier 6 or other notifier means may be controlled to warn the operator of such an erroneous switching operation. Whereby, the operator can more securely perform the switching operation with high reliability.

Then, large quantity or successive printing is performed while the double sheet detection is made by using a proper double sheet detector switched in Step S14 (Step S15).

Thus, the double sheet detector to be employed in large quantity or successive printing is notified based on the result of the ultrasonic double sheet detector 2 in test printing, so that the operator can select a proper double sheet detector and more securely perform printing preparatory work for more secured double sheet detection.

As described, it is also possible, in this embodiment, to employ the photoelectric double sheet detector 1 along with the ultrasonic double sheet detector 2 in test printing. That is, it is possible to employ a sheet-fed printing press that includes a photoelectric double sheet detector 1 and an ultrasonic double sheet detector 2, both being adapted to output double sheet detected signal when they each have judged that two or more overlapped sheets are being fed, and a notifier 6 for notifying an operator which double sheet detector of the double sheet detectors is to be employed based on the judged results of the photoelectric double sheet detector 1 and the ultrasonic double sheet detector 2, so that the notifier 6 notifies the operator that the photoelectric double sheet detector 1 is to be employed as a double sheet detector for use in large quantity or successive printing when the ultrasonic double sheet detector 2 output double sheet detected signal during test printing or during a first printing sheet of successively fed printing sheets in large quantity or successive printing, the notifier 6 notifies the operator that the ultrasonic double sheet detector 2 as a double sheet detector for use in large or successive printing when the ultrasonic double sheet detector 2 did not output double sheet detected signal while ultrasonic double sheet detector 2 output double sheet detected signal during test printing or during feeding a first printing sheet of successively fed printing sheets in large quantity or successive printing, and the notifier 6 notifies the operator that at least one of the photoelectric double sheet detector 1 and the ultrasonic double sheet detector 2 is to be employed as a double sheet detector for use in large or successive printing when the photoelectric double sheet detector 1 and the ultrasonic double sheet detector 2 did not output double sheet detected signal during test printing or during feeding a first printing sheet of successively fed printing sheets in large quantity or successive printing.

For the sheet-fed printing presses of the above two embodiments, the description was made in the manner that both the printing presses are arranged independently of each other. As an alternative for this, it is possible to employ an arrangement where the above two embodiments can be properly selected in a single printing press according to needs and circumstances.

This specification is by no means intended to restrict the present invention to the preferred embodiments set forth therein. Various modifications to the sheet-fed printing press, as described herein, may be made by those skilled in the art without departing from the spirit and scope of the present invention as defined in the appended claims.

What is claimed is:

1. A sheet-fed printing press comprising:

a photoelectric double sheet detector and an ultrasonic double sheet detector, both being adapted to output double sheet detected signal when they each have judged that two or more overlapped sheets are being fed; and a double-sheet-detector control part for automatically switching the photoelectric double sheet detector and the ultrasonic double sheet detector so as to employ the photoelectric double sheet detector as a double sheet detector for use in large quantity or successive printing when the ultrasonic double sheet detector output double sheet detected signal during test printing or during feeding a first printing sheet of successively fed printing sheets in large quantity or successive printing, and employ the ultrasonic double sheet detector as a double sheet detector for use in large or successive printing when the ultrasonic double sheet detector did not output double sheet detected signal during test printing or during feeding a first printing sheet of successively fed printing sheets in large quantity or successive printing.

2. A sheet-fed printing press comprising:

a photoelectric double sheet detector and an ultrasonic double sheet detector, both being adapted to output double sheet detected signal when they each have judged that two or more overlapped sheets are being fed; and a double-sheet-detector control part for automatically switching the photoelectric double sheet detector and the ultrasonic double sheet detector so as to employ the photoelectric double sheet detector as a double sheet detector for use in large quantity or successive printing when the ultrasonic double sheet detector output double sheet detected signal during test printing or during feeding a first printing sheet of successively fed printing sheets in large quantity or successive printing, employ the ultrasonic double sheet detector as a double sheet detector for use in large or successive printing when the ultrasonic double sheet detector did not output double sheet detected signal while the photoelectric double sheet detector output double sheet detected signal during test printing or during feeding a first printing sheet of successively fed printing sheets in large quantity or successive printing, and employ at least one of the photoelectric double sheet detector and the ultrasonic double sheet detector as a double sheet detector for use in large or successive printing when both the photoelectric double sheet detector and the ultrasonic double sheet detector did not output double sheet detected signal during test printing or during feeding a first printing sheet of successively fed printing sheets in large quantity or successive printing.

3. A sheet-fed printing press comprising:

a photoelectric double sheet detector and an ultrasonic double sheet detector, both being adapted to output double sheet detected signal when they each have judged that two or more overlapped sheets are being fed; and a notifier for notifying an operator which double sheet detector of said double sheet detectors is to be employed, so that the notifier notifies the operator that the photoelectric double sheet detector is to be employed as a double sheet detector for use in large quantity or successive printing when the ultrasonic double sheet detector output double sheet detected signal during test printing or during a first printing sheet of successively fed printing sheets in large quantity or successive printing, and the notifier notifies the operator that the ultrasonic double sheet detector is to be employed as a double sheet detector for use in large or successive printing when the ultrasonic double sheet detector did not output double sheet detected signal during test printing or during a first printing sheet of successively fed printing sheets in large quantity or successive printing.

* * * * *